US006931751B2

(12) United States Patent
LaTulippe

(10) Patent No.: US 6,931,751 B2
(45) Date of Patent: Aug. 23, 2005

(54) METHODS AND APPARATUS FOR SECURING COMPONENTS FOR INSPECTION

(75) Inventor: Michael T. LaTulippe, Fairfield, OH (US)

(73) Assignee: General Electric Company, Schenectady, NY (US)

( * ) Notice: Subject to any disclaimer, the term of this patent is extended or adjusted under 35 U.S.C. 154(b) by 61 days.

(21) Appl. No.: 10/229,692

(22) Filed: Aug. 28, 2002

(65) Prior Publication Data

US 2005/0076523 A1 Apr. 14, 2005

(51) Int. Cl.[7] ..... G01B 5/00; B25B 1/00

(52) U.S. Cl. ..... 33/573; 33/568; 33/549; 269/91; 269/203; 269/153; 451/365

(58) Field of Search ..... 33/573, 568, 503, 33/549, 535, 533, 501, 613, 645; 269/203–204, 91, 94, 296, 238, 236, 228, 152–153; 451/365, 387, 405

(56) References Cited

U.S. PATENT DOCUMENTS 3,150,870 A * 9/1964 Nelson ..... 269/91
3,758,100 A * 9/1973 Taylor et al. ..... 269/203
4,333,239 A 6/1982 Arrigoni
4,665,625 A 5/1987 Ireland et al.
4,691,905 A * 9/1987 Tamura et al. ..... 269/296
4,805,505 A * 2/1989 Cantlin ..... 33/613
4,905,745 A * 3/1990 Jaeger ..... 33/563
5,167,405 A * 12/1992 Cayley, Jr. ..... 269/309
5,191,717 A * 3/1993 Fujitani et al. ..... 33/503
5,299,609 A * 4/1994 Wedler ..... 33/613
5,343,627 A * 9/1994 Hesseltine ..... 33/535
5,507,101 A * 4/1996 Mason ..... 33/608
5,516,087 A * 5/1996 Schmid et al. ..... 269/91
5,575,145 A 11/1996 O'Neil et al.
5,593,085 A 1/1997 Tohill et al.
5,637,838 A * 6/1997 Arey et al. ..... 33/511
5,711,083 A * 1/1998 Bidwell ..... 33/543
5,852,269 A 12/1998 Toyonaga et al.
5,954,322 A * 9/1999 Boria ..... 269/296
6,068,541 A * 5/2000 Dwyer ..... 269/296
6,073,360 A * 6/2000 Struble ..... 33/783
6,158,113 A * 12/2000 Saito et al. ..... 29/760
6,409,471 B1 6/2002 Stow
6,442,857 B1 * 9/2002 Atsuhiko et al. ..... 33/553
2003/0051769 A1 * 3/2003 Welsh et al. ..... 144/287

* cited by examiner

*Primary Examiner*—Diego Gutierrez
*Assistant Examiner*—Yaritza Guadalupe
(74) *Attorney, Agent, or Firm*—Armstrong Teasdale LLP; William Scott Andes

(57) ABSTRACT

A method enables a component to be secured for inspection. The method comprises providing a tool including a first clamping member and a second clamping member coupled to a guide rail assembly, fixedly securing the first clamping member to the guide rail assembly, slidably coupling the second clamping member to the guide rail assembly such that the second clamping member is substantially parallel to the first clamping member, and securing the component within the tool between the first and second clamping members such that the first and second clamping members are fixedly secured in position with respect to the guide rail assembly.

17 Claims, 3 Drawing Sheets

METHODS AND APPARATUS FOR SECURING COMPONENTS FOR INSPECTION

BACKGROUND OF THE INVENTION

This invention relates generally to inspection techniques, and more specifically to methods and apparatus for securing components for inspection.

Accurately measuring a surface of an object may be a significant factor in determining a manufacturing time of the object, as well as a factor used to determine subsequent maintenance and repair costs and activities. More specifically, when the object is a gas turbine engine shroud, accurately measuring the contour of the shroud may be one of the most significant factors affecting an overall cost of fabrication of the gas turbine engine, as well as subsequent modifications, repairs, and inspections of the blade airfoils.

Coordinate measuring machines (CMMs) have also been used to obtain dimensional information of an object. Within such systems, a probe is positioned within a three-coordinate measurement space to contact an object surface, at which time the position of the probe tip is measured. The process is repeated many times to determine a surface contour. To accurately map the surface profile and location of the shroud, the shroud must be aligned within a fixture and with respect to a datum for use by the CMM.

To facilitate accurate alignment of the different sized shrouds with respect to the datum, within at least some known inspection systems, a unique fixture is manufactured and assembled for each shroud to be inspected. However, assembling or manufacturing a different fixture that is capable of maintaining the position of the shroud with respect to the datum may be a labor-intensive and costly process.

BRIEF SUMMARY OF THE INVENTION

In one aspect a method for securing a component for inspection is provided. The method comprises providing a tool including a first clamping member and a second clamping member coupled to a guide rail assembly, fixedly securing the first clamping member to the guide rail assembly, slidably coupling the second clamping member to the guide rail assembly such that the second clamping member is substantially parallel to the first clamping member, and securing the component within the tool between the first and second clamping members such that the first and second clamping members are fixedly secured in position with respect to the guide rail assembly.

In another aspect of the invention, a tool is provided. The tool includes a guide rail assembly, a first clamping member, and a second clamping member. The guide rail assembly includes a centerline axis of symmetry, the first clamping member extends outwardly from the guide rail assembly. The second clamping member extends outwardly from the guide rail assembly, and at least one of the first and the second clamping members is slidably coupled to the guide rail assembly. The first and said second clamping members are configured to retain a component therebetween.

In a further aspect, an apparatus for securing a component for inspection is provided. The apparatus includes a guide rail assembly, a first clamping member, and a second clamping member. The first clamping member is coupled to the guide rail assembly and extends substantially perpendicularly from the guide rail assembly. The second clamping member is coupled to the guide rail assembly and extends substantially perpendicularly from the guide rail assembly. The second clamping member is substantially parallel the first clamping member, and at least one of (the first clamping member and the second clamping member is fixedly secured in position with respect to the guide rail assembly. Furthermore, at least one of the first clamping member and the second clamping member is slidably coupled to the guide rail assembly.

DETAILED DESCRIPTION OF THE INVENTION

Figure 1:
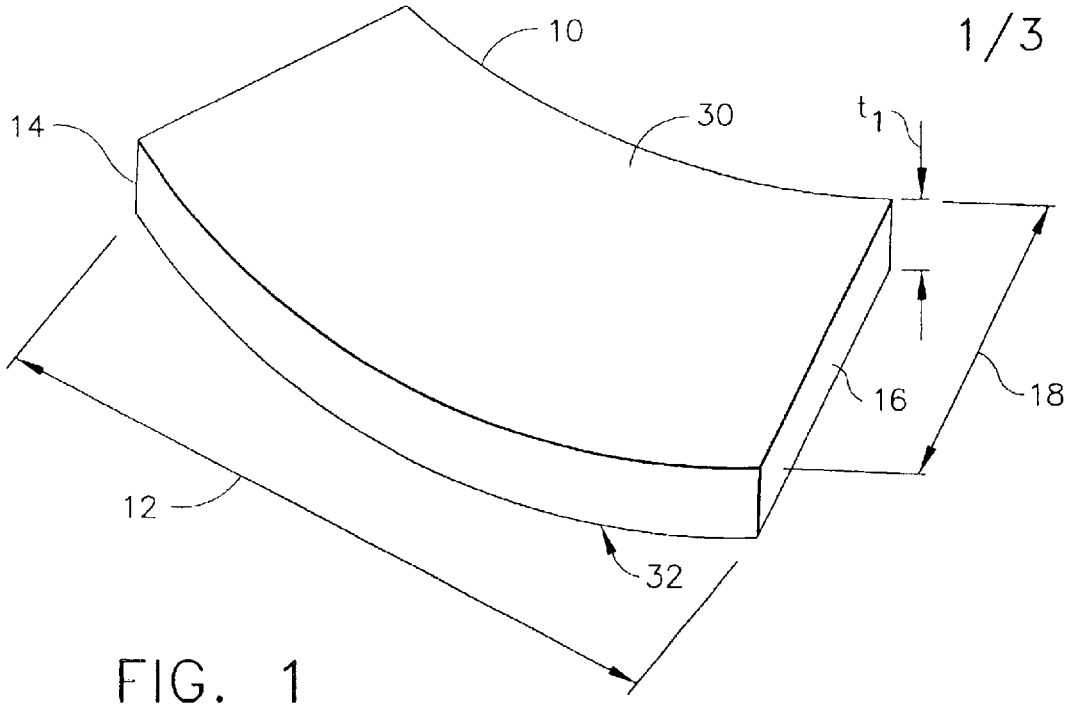
FIG. 1 is perspective view of an exemplary gas turbine engine shroud.

FIG. 1 is perspective view of an exemplary gas turbine engine shroud 10. In one embodiment, a plurality of shrouds 10 extend circumferentially around a turbine nozzle assembly (not shown) used within a gas turbine engine, such as a GE90 available from General Electric Company, Cincinnati, Ohio. Shroud 10 is arucate cross-sectional profile, and has a width 12 extending between a pair of side edges 14 and 16, and a length 18 extending between an upstream edge 20 and a downstream edge 22. Shroud 10 has a thickness $t_1$ measured between a radially inner surface 30 and a radially outer surface 32. In the exemplary embodiment, radially inner surface 30 is contoured and is substantially parallel radially outer surface 32.

Figure 4:
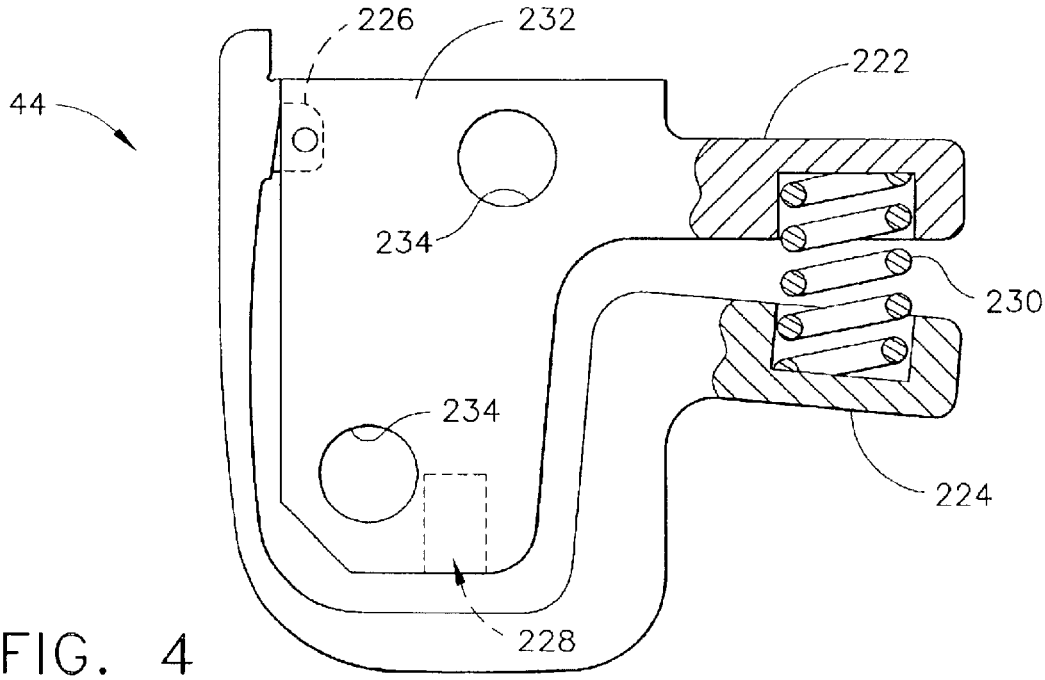
FIG. 4 is a side view of a biasing mechanism that is used with the fixture shown in FIG. 2.
Figure 2:
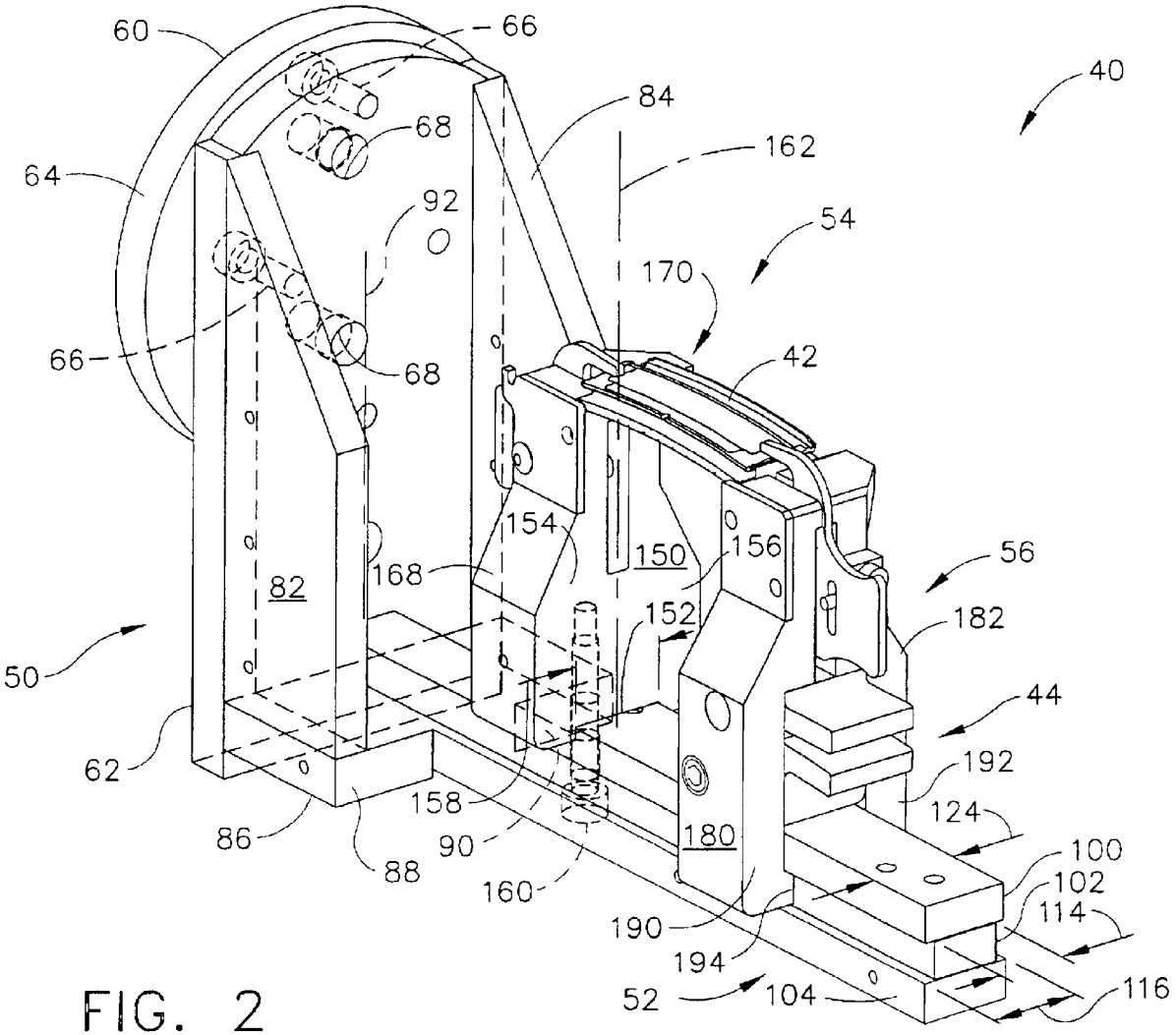
FIG. 2 is perspective view of a fixture for use in securing a component, such as the shroud shown in FIG. 1, in alignment for inspection.
Figure 3:
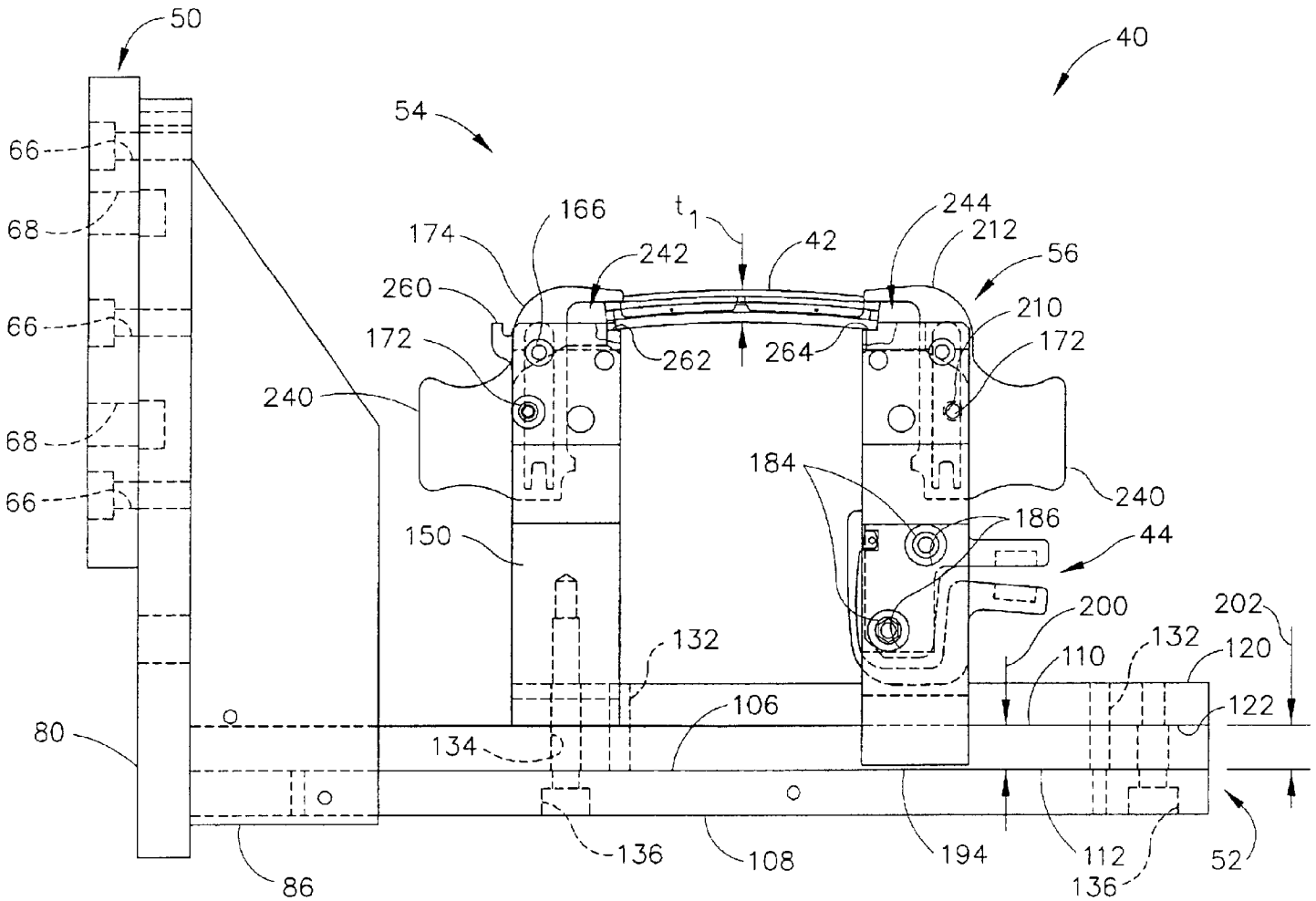
FIG. 3 is a side view of the fixture shown in FIG. 2.

FIG. 2 is perspective view of a fixture 40 used to secure a component 42, such as shroud 10, in alignment for inspection. FIG. 3 is a side view of fixture 40. FIG. 4 is a side view of a biasing mechanism 44 used with fixture 40, as described in more detail below. In another embodiment, fixture 40 is used to secure components for non-inspection purposes. Alternatively, fixture 40 is used to secure other components other than shroud 10. Fixture 40 includes a mounting assembly 50, a guide rail assembly 52, a first clamping assembly 54, and a second clamping assembly 56.

Mounting assembly 50 includes a mounting plate 60 that is coupled against a mounting flange 62. In the exemplary embodiment, mounting plate 60 has a substantially circular outer perimeter 64 and includes a plurality of first openings 66 and a plurality of second openings 68. First openings 66 are each sized to receive a fastener 70 therethrough for coupling mounting plate 60 to flange 62. Mounting plate second openings 68 are each sized to receive a fastener (not shown) therethrough for coupling fixture 40 to a rotary table (not shown) for use with a coordinate measuring machine (CMM) (not shown). In one embodiment, mounting plate 60 enables fixture 40 to be coupled to a Direct Drive Rotary Stage Table, Model No. ADR175-M-9-RE50AS-U-HM commercially available from Aerotech Incorporated, Pittsburgh, Pa.

Mounting flange 62 includes a substantially planar base 80 and a pair of sidewalls 82 and 84 that extend outwardly from base 80. In the exemplary embodiment, sidewalls 82 and 84 extend substantially perpendicularly from base 80 and as such, are substantially parallel. Each sidewall 82 and 84 is coupled to a bifurcated base wall 86 that extends from each respective sidewall 82 and 84 towards the other respective sidewall 84 and 82. Specifically, base wall 86 includes a first portion 88 that extends substantially perpendicularly from sidewall 82, and a second portion 90 that extends substantially perpendicularly from sidewall 84, such that portions 88 and 90 are substantially co-planar and extend towards a center line 92 extending through mounting flange 62. Sidewalls 82 and 84, and base wall 86 provide structural support to mounting assembly 50 and to guide rail assembly 52.

Guide rail assembly 52 includes an upper rail 100, a center rail 102, and a base rail 104 coupled together. Base rail 104 extends substantially perpendicularly from mounting assembly 50. More specifically, base rail 104 extends substantially perpendicularly from mounting flange base 80 between base wall portions 88 and 90, such that each base wall portion 88 and 90 is fixedly coupled against base rail 104 and provides additional structural support to rail 104. Rail 104 is substantially planar and includes an upper surface 106 and a lower surface 108 that is substantially parallel to upper surface 106.

Center rail 102 is substantially planar and includes an upper surface 110 and a lower surface 112 that is substantially parallel to upper surface 110. A width 114 of center rail 102 is less than a width 116 of base rail 104. Center rail 102 is coupled between base rail 102 and upper rail 100 such that center rail 102 is substantially concentrically aligned with respect to rails 100 and 102, and such that center rail upper surface 110 is against upper rail 100 and such that center rail lower surface 112 is against base rail upper surface 106.

Upper rail 100 is substantially planar and includes an upper surface 120 and a lower surface 122 that is substantially parallel to upper surface 120. A width 124 of upper rail 100 is wider than center rail width 114, such that when upper rail 100 is coupled against center rail 102, which is coupled against base rail 104, guide rail assembly 52 has a substantially I-shaped cross sectional profile. In the exemplary embodiment, upper rail width 124 is approximately equal base rail width 116.

Guide rail assembly 52 also includes a plurality of openings 130 that extend at least partially through center, and base rails 100, 102, and 104, respectively. Openings 130 are sized to receive fasteners 132 used to couple guide rail assembly 52 together. A plurality of additional openings 134 extend through guide rail assembly 52 for receiving a fastener 136 used for coupling clamping assembly 54 to guide rail assembly 52.

In the exemplary embodiment, clamping assembly 54 includes a unitary body 150 that defines a saddle portion 152. Alternatively, body 150 is constructed of a plurality of body portions coupled together. Body saddle portion 152 is defined by a pair of legs 154 and 156 that extend outwardly from body 150. Specifically, saddle portion 152 has a width 158 that is slightly larger than upper rail width 124 such that when clamping assembly 54 is coupled to upper rail 100, upper rail 100 is received in tight tolerance between legs 154 and 156 within saddle portion 152, and such that body 150 extends substantially perpendicularly from upper rail 100.

An opening 160 from saddle portion 152 into body 150 along a centerline 162 of clamping assembly 54. Accordingly, opening 160 is midway between legs 154 and 156 and is sized to receive fastener 136 therein for coupling clamping assembly 54 to guide rail assembly 52. More specifically, fastener 136 extends through a selected guide rail assembly opening 134 and into opening 160 for securing clamping assembly 54 in position relative to guide rail assembly 52.

Clamping assembly body 150 includes an additional opening 166 that extends laterally through body 150 from a first side 168 of body 150 to a second side 170 of body 150. Opening 166 is sized to receive a fastener 172 therethrough used for securing a set clip 174 (described in more detail below) to clamping assembly 54.

Clamping assembly 56 is slidably coupled to guide rail assembly 52 such that clamping assembly 54 is between assembly 56 and mounting assembly 50. In the exemplary embodiment, clamping assembly 56 includes a first body portion 180 and a second body portion 182 coupled together by a pair of fasteners 184 extending through fastener openings 186 defined in body portions 180 and 182.

Each body portion 180 and 182 includes a leg 190 and 192, respectively, that extends outwardly from each respective body portion 180 and 182. Each respective leg 190 and 192 includes a footing 194 that enable each respective body portion 180 and 182 to be slidably coupled to guide rail assembly 52. More specifically, each footing 194 has a height 200 that is less than a height 202 of center rail 102, such that each footing 194 and 196 is slidably coupled along center rail 102 between rails 100 and 104 when clamping assembly 56 is coupled to guide rail assembly 52, and such that clamping assembly 56 extends substantially perpendicularly from guide rail assembly 52.

Clamping assembly body portions 182 and 184 each include an additional opening 210 that extends laterally through each body portion 182 and 184. Opening 210 is sized to receive fastener 172 therethrough used for securing a set clip 212 (described in more detail below) to clamping assembly 56.

Body portions 182 and 184 are coupled together by fasteners 184 such that each portion 182 and 184 extends substantially perpendicularly from guide rail assembly 52, and such that portion 182 is substantially parallel portion 184. Additionally, portions 182 and 184 are coupled together by fasteners 184 such that a biasing mechanism 44 is coupled therebetween. Biasing mechanism 44 frictionally couples clamping assembly 56 to guide rail assembly 52. Specifically, biasing mechanism 44 includes a pair of arms 222 and 224 that are coupled together at a hinge 226 such that a first spring member 228 and a second spring member 230 extend therebetween. More specifically, biasing member arms 222 and 224 extend outwardly from a body 232 that includes a pair of openings 234 sized to receive fasteners 184 therethrough for coupling biasing mechanism 44 between body portions 182 and 184.

In a relaxed state, as shown in FIG. 3, biasing mechanism 44 is biased such that biasing mechanism body 232 frictionally engages guide rail assembly 52. Specifically, in a relaxed state, biasing mechanism body 232 frictionally engages upper rail upper surface 120 to prevent movement of clamping assembly 56 with respect to guide rail assembly 52. When biasing member arms 222 and 224 are squeezed together, spring members 228 and 230 are compressed, and clamping assembly 56 is movable along guide rail assembly 52. Moving clamping assembly 56 enables a distance 236 between clamping assembly 54 and 56 to be variably selected to accommodate a width 12 and/or a length 18 of the component 10 being secured within fixture 10. Furthermore, biasing mechanism 44 facilitates moving clamping assembly 56 such that assembly 56 remains substantially parallel to, and facing clamping assembly 54.

Set clips 174 and 212 are substantially similar and each is selectively positionable with respect to a respective claming assembly 54 and 56. More specifically, each set clip 174 and 212 is coupled to a handle 240 that is shifted to vary a position of each set clip 174 and 212. Specifically, moving handle 240 causes each set clip 174 and 212 to travel in a direction that is substantially perpendicular to guide rail assembly 52 and such that a gap 242 and 244 defined between each respective set clip 174 and 212, and clamping assembly 54 and 56 is varied. Gaps 242 and 244 are variably selected to accommodate a thickness $t_1$ of the component 10 being secured by fixture 40.

In the exemplary embodiment, a plurality of alignment devices 260 extend from each clamping assembly 54 and 56, and from each set clip 174 and 212. Alignment devices 260 facilitate positioning the component 10 being secured by fixture 10 in alignment with a datum that is used during inspection by a CMM. More specifically, each clamping assembly 54 and 56 includes a recessed area 262 and 264 adjacent gaps 242 and 244, respectively. Recessed areas 262 and 264 receive component 10 therein and establish a primary datum reference point for fixture 40. Alignment devices 260 function as stop locks and create a secondary contact or datum reference point, and when each set clip 174 and 212 is adjusted, clips 174 and 212 create a tertiary datum reference point.

During operation, clamping member 54 is initially secured to guide rail assembly 52 based on an overall size of the component 10 being inspected. Specifically, clamping member 54 is secured in position relative to guide rail assembly 52 by fastener 136, and clamping member 56 is slidably coupled to guide rail assembly 52. Biasing mechanism 44 is compressed and clamping member 56 is positioned with respect to clamping member 54 to accommodate a width 12 or length 18 of the component 10 being secured by fixture 40.

Set clips 174 and 212 are then adjusted to vary gaps 242 and 244 to accommodate a thickness $t_1$ of component 10, and component 10 is then received within gaps 242 and 244. More specifically, component 10 is positioned within gaps 242 and 244 in alignment with respect to a datum by alignment devices 260. Once properly aligned with respect to fixture 40, set clips 174 and 212 are secured against component 10 to maintain component in alignment during the inspection process. Furthermore, once aligned and secured within clips 174 and 212, biasing mechanism 44 is released such that clamping member 56 frictionally engages guide rail assembly 52 to secure clamping member 56 in position relative to guide rail assembly 52. Fixture 40 is then coupled to the rotary table using fasteners which extend through mounting assembly openings 68.

The above-described fixture is cost-effective and highly reliable. The fixture includes a pair of clamping assemblies that are coupled to a guide rail assembly such that a component secured within the fixture in alignment with respect to a datum. Furthermore, because the clamping assemblies are variably positionable, and because the spring clips are variably positionable, a plurality of different sized components may be secured within the fixture in alignment with respect to the datum. Accordingly, the above-described fixtures facilitate securing a plurality of components in alignment in a in a cost-effective and reliable manner.

While the invention has been described in terms of various specific embodiments, those skilled in the art will recognize that the invention can be practiced with modification within the spirit and scope of the claims.

What is claimed is:

1. A method for securing a component for inspection, said method comprising:

providing a tool including a first clamping member and a second clamping member coupled to a guide rail assembly that is formed from at least three rails coupled together, wherein the at least three rails extend generally parallel with respect to one another, a center one of the at least three rails has a width that is narrower than a width of the other two rails, at least one of the clamping members engaging the guide rail assembly adjacent opposing faces of the center one of the three rails;

fixedly securing the first clamping member to the guide rail assembly;

slidably coupling the second clamping member to the guide rail assembly such that the second clamping member is substantially parallel to the first clamping member; and securing the component within the tool between the first and second clamping members such that the first and second clamping members are fixedly secured in position with respect to the guide rail assembly and such that the second clamping member is frictionally coupled to the guide rail assembly by a biasing mechanism that includes a pair of hinged arms biased apart by a spring.

2. A method in accordance with claim 1 wherein securing the component within the tool between the first and second clamping members further comprises frictionally coupling the second clamping member to the guide rail assembly by a biasing mechanism.

3. A method in accordance with claim 1 wherein securing the component within the tool between the first and second clamping members further comprises aligning the component with respect to a datum using an alignment mechanism extending from each clamping member.

4. A method in accordance with claim 1 wherein securing the component within the tool between the first and second clamping members further comprises:

sliding the second clamping member along the guide rail assembly in a direction that is substantially parallel to a centerline axis of symmetry extending through the guide rail assembly; and moving at least a portion of the first and second clamping members away from the guide rail assembly in a direction that is substantially perpendicular to the guide rail assembly centerline axis of symmetry.

5. A tool comprising:

a guide rail assembly comprising a centerline axis of symmetry and at least three rails coupled together, wherein said at least three rails extend generally parallel with respect to one another, a center one of said at least three rails has a width that is narrower than a width of said remaining rails;

a first clamping member extending outwardly from said guide rail assembly; and a second clamping member extending outwardly from said guide rail assembly, at least one of said first and said second clamping members slidably coupled to said guide rail assembly, at least one of said clamping members engaging said guide rail assembly adjacent opposing faces of said center one of said three rails, said first and said second clamping members configured to retain a component therebetween, at least one of said first and said second clamping members comprises a biasing mechanism for frictionally engaging said guide rail assembly for maintaining a position of at least one of said first and said second clamping member with respect to said guide rail assembly.

6. A tool in accordance with claim 5 wherein said first clamping member substantially parallel and facing said second clamping member.

7. A tool in accordance with claim 5 wherein said biasing mechanism comprises at least one hinge and at least one spring.

8. A tool in accordance with claim 5 wherein at least one of said first and said second clamping member comprises an alignment mechanism configured to position the component in alignment with respect to a datum.

9. A tool in accordance with claim 5 wherein at least one of said first and said second clamping member is slidable along said guide rail assembly in a first direction that is substantially parallel to said guide rail assembly centerline axis of symmetry, and in a second direction that is substantially perpendicular to said guide rail assembly centerline axis of symmetry.

10. A tool in accordance with claim 5 wherein each said first and second clamping member comprises a retaining member, each said retaining member selectively adjustable to receive a portion of the component therein.

11. A tool in accordance with claim 5 wherein said biasing mechanism comprises a pair of hinges arms biased apart by a spring.

12. An apparatus for securing a component for inspection, said apparatus comprising:

a guide rail assembly comprising at least two rails coupled together, wherein a first of said at least two guide rails has a first width, a second of said at least two guide rails has a second width, said first width is wider than said second width such that at least one shoulder is defined between said first and second rails;

a first clamping member coupled to said guide rail assembly and extending substantially perpendicularly from said guide rail assembly; and a second clamping member coupled to said guide rail assembly and extending substantially perpendicularly from said guide rail assembly, said second clamping member substantially parallel said first clamping member, at least one of said first clamping member and said second clamping member fixedly secured in position with respect to said guide rail assembly, at least one of said first clamping member and said second clamping member slidably coupled to said guide rail assembly such that a portion of one of said first clamping member and said second clamping member positioned adjacent to opposing faces of said second rail and retained by said at least one shoulder, at least one of said first and said second clamping members comprising a biasing mechanism for frictionally engaging said guide rail assembly for maintaining a position of at least one of said first and said second clamping member with respect to said guide rail assembly.

13. Apparatus in accordance with claim 12 wherein said guide rail assembly comprises a centerline axis of symmetry, at least one of said first clamping member and said second clamping member slidably coupled along said guide rail in a direction that is substantially parallel said guide rail centerline axis of symmetry.

14. Apparatus in accordance with claim 12 wherein said guide rail assembly comprises a centerline axis of symmetry, at least one of said first clamping member and said second clamping member selectively movable with respect to said guide rail assembly in a direction that is substantially perpendicular said guide rail centerline axis of symmetry.

15. Apparatus in accordance with claim 12 wherein said biasing mechanism comprises at least one hinge and at least one spring.

16. Apparatus in accordance with claim 12 wherein at least one of said first clamping member and said second clamping member configured to maintain a position of the component with respect to an inspection datum.

17. Apparatus in accordance with claim 12 wherein said biasing mechanism comprises a pair of hinged arms biased apart by a spring, compressing said spring enables selective movement of at least one of said first clamping member and said second coupling member with respect to said guide rail assembly.

* * * * *